United States Patent [19]

Clayton

[11] Patent Number: 4,951,850

[45] Date of Patent: Aug. 28, 1990

[54] POURING SPOUT

[76] Inventor: Carl W. Clayton, 7609 Terry Dr., Omaha, Nebr. 68128

[21] Appl. No.: 377,047

[22] Filed: Jul. 10, 1989

[51] Int. Cl.[5] ..... B67D 3/00

[52] U.S. Cl. ..... 222/535; 222/556; 229/125.11

[58] Field of Search ..... 222/364, 535, 560, 559, 222/80, 556, 544, 481, 482; 229/125.11, 125.14, 125.15; 221/23

[56] References Cited

U.S. PATENT DOCUMENTS

| | | | |
|---|---|---|---|
| 2,311,255 | 2/1943 | Read | 221/23 |
| 2,747,771 | 5/1956 | Mercer | 222/81 |
| 2,876,933 | 3/1959 | Eyster | 222/85 |
| 2,877,932 | 3/1959 | Whitmire | 222/83 |
| 2,889,976 | 6/1959 | Cantfort | 229/7 |
| 2,927,695 | 3/1960 | Bartolomeo | 229/125.14 |
| 3,057,525 | 10/1962 | Malachick | 222/482 |
| 4,111,351 | 9/1978 | Mackiernan | 229/17 M |

*Primary Examiner*—H. Grant Skaggs
*Assistant Examiner*—Kenneth Noland
*Attorney, Agent, or Firm*—Zarley, McKee, Thomte, Voorhees & Sease

[57] ABSTRACT

A pouring spout for a package comprising a face plate which is positioned adjacent the upper end of one of the end walls of the package and which has an upper support extending horizontally inwardly from the upper end thereof over the top wall of the package. The upper end of the pouring spout is maintained in position by means of a pin extending downwardly through the upper support and through the top wall of the package. A pivotal spout is pivotally mounted on the face plate and is positioned in an opening which has been created in the upper end of the end wall of the package. The pouring spout includes a lower support which engages the inside surface of the package below the opening in which the spout is mounted to maintain the lower end of the pouring spout in position.

4 Claims, 2 Drawing Sheets

POURING SPOUT

BACKGROUND OF THE INVENTION

This invention relates to a pouring spout and more particularly to a pouring spout adapted for use with a generally rectangular package.

Many types of pouring spouts have been provided for packages such as cereal boxes, pancake mix boxes, etc. Some of the prior art devices have been formed integrally with the package while other of the pouring spouts have been add-on devices.

The integrally formed pouring spouts have limited use in that they will be disposable with the package when the package is empty. The add-on devices of the prior art are either not convenient to use, are not durable in use, or leak.

It is therefore a principal object of the invention to provide an improved pouring spout.

Still another object of the invention is to provide a pouring spout for use with a generally rectangular package such as cereal boxes, pancake mix boxes, etc.

Still another object of the invention is to provide a pouring spout of the add-on type which is durable in use and which prevents leakage of the contents of the box during storage and during use.

Still another object of the invention is to provide a pouring spout of the add-on type which is economical of manufacture.

Still another object of the invention is to provide a pouring spout of the add-on type which may be used on any package having a width of two inches or larger.

These and other objects will be apparent to those skilled in the art.

SUMMARY OF THE INVENTION

Figure 1:
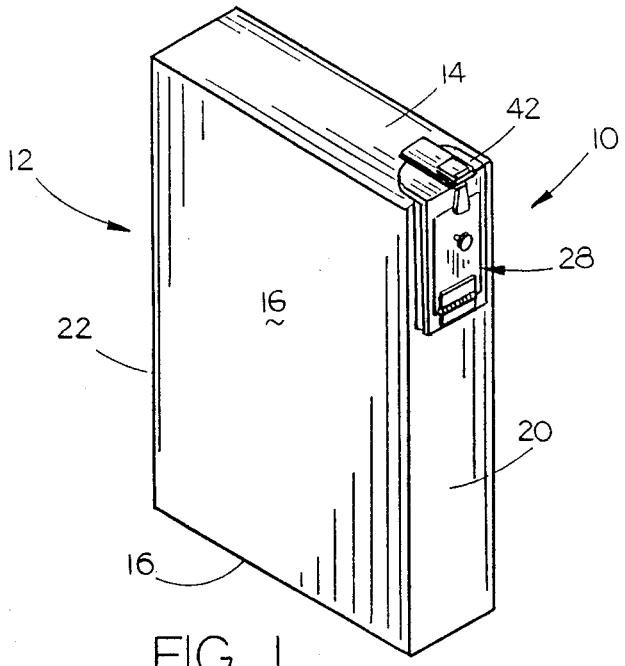
FIG. 1 is a perspective view of the pouring spout of this invention mounted on a package.
Figure 2:
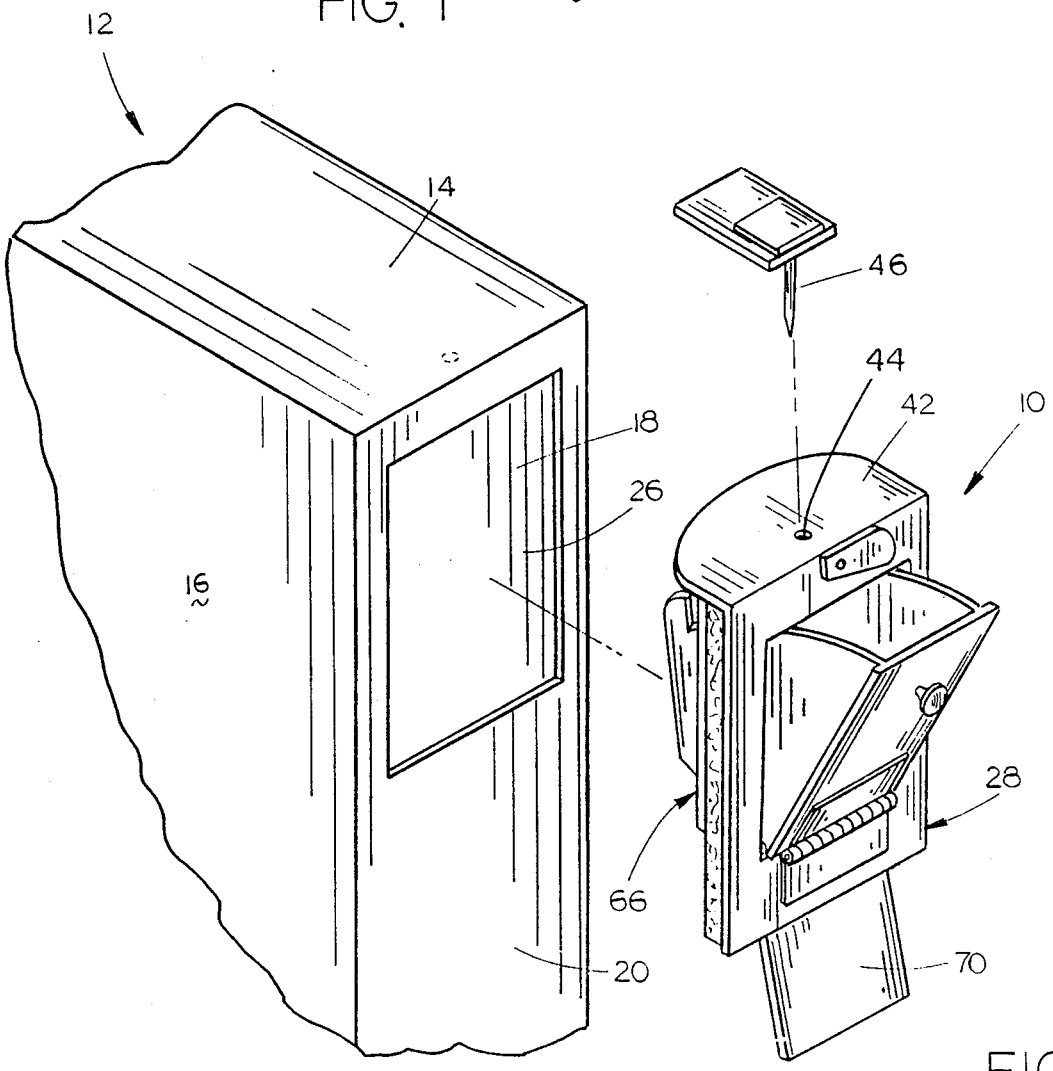
FIG. 2 is a perspective view of the invention and a package.
Figure 3:
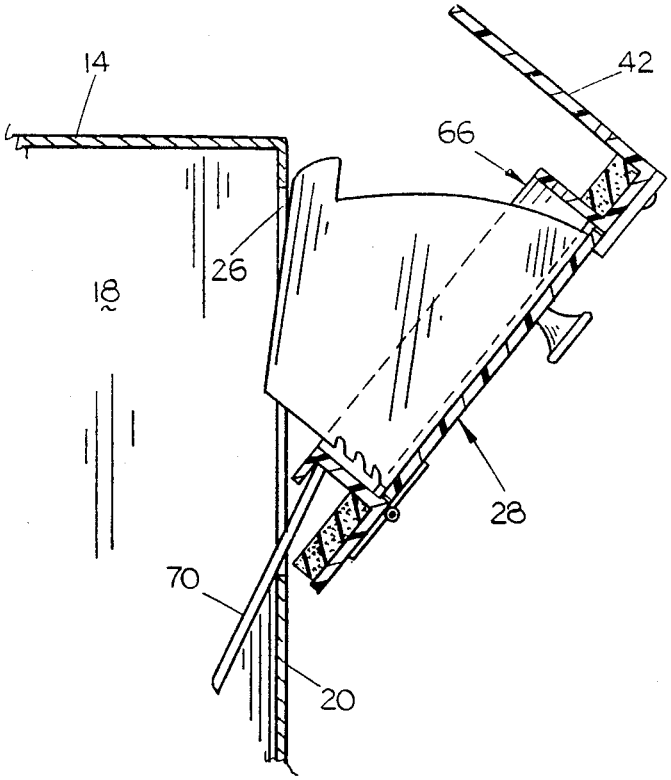
FIG. 3 is a sectional view illustrating the pouring spout of this invention being inserted into a package.
Figure 4:
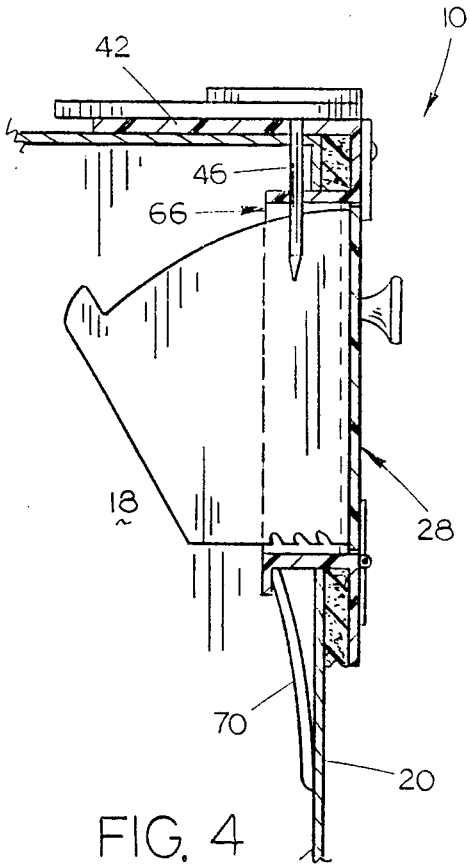
FIG. 4 is a view similar to FIG. 3 except that the pouring spout has been positioned in the package.
Figure 5:
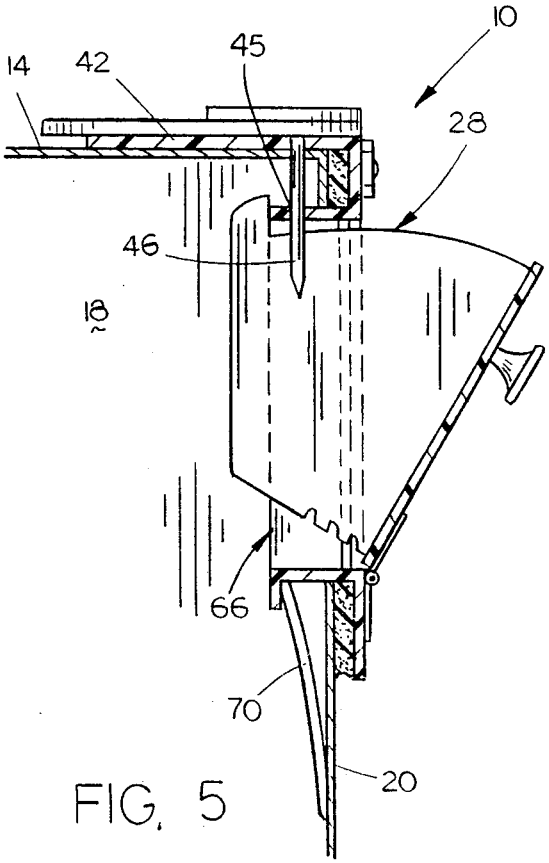
FIG. 5 is a sectional view similar to FIG. 4 except that the spout portion has been moved to its open position.
Figure 6:
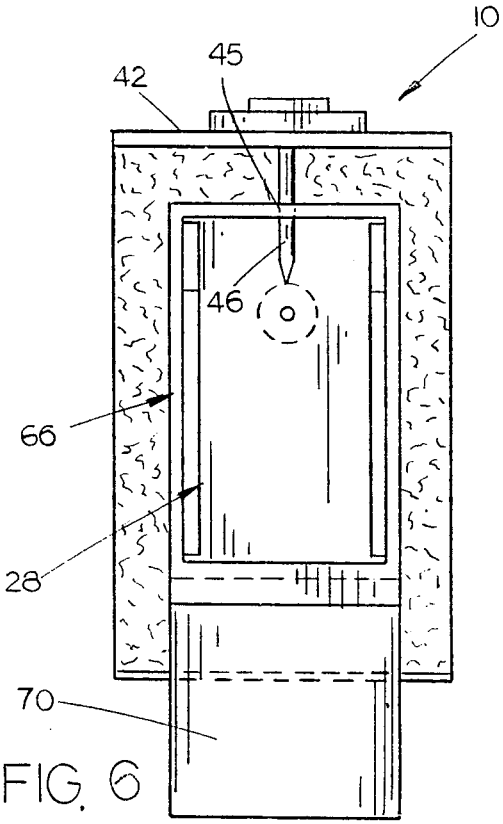
FIG. 6 is a back elevational view of the invention mounted on a package.

A pouring spout is described which is designed to be used with a generally rectangular package having a top wall, side walls, end walls and a bottom wall. The pouring spout of the invention is inserted into an opening formed in the upper end of one of the end walls of the package and includes means for positively maintaining the pouring spout in position when mounted on the box. The pouring spout includes a face plate which is positioned adjacent the upper end of the end wall and which has a spout means pivotally mounted thereon which extends inwardly into the opening in the package. A top support extends horizontally from the upper end of the face plate over the top wall of the package and has a pin extending downwardly therethrough into the package to maintain the pouring spout on the package. The pouring spout also has a lower support which engages the inside surface of the package below the opening formed therein to also maintain the pouring spout in position. The spout means may be pivotally moved from an open position to a closed position.

DESCRIPTION OF THE PREFERRED EMBODIMENT

The pouring spout of this invention is referred to generally by the reference numeral 10 while the reference numeral 12 refers to a conventional package for cereal, mixes, etc. including top wall 14, side walls 16 and 18, end walls 20 and 22, and bottom wall 24. To utilize the pouring spout of this invention, a rectangular opening 26 must be formed in end wall 20 adjacent the upper end thereof.

Pouring spout 10 includes a face plate 28 having an upper end 30, lower end 32 and opposite side edges 34 and 36. For purposes of description, face plate 28 will be described as having an outer surface 38 and an inner surface 40.

Upper support 42 extends horizontally inwardly from the upper end of face plate 28 and has an opening 44 formed therein adapted to receive pin 46 extending downwardly therethrough.

Face plate 26 is provided with a central opening 48 formed therein. Spout means 50 is pivotally mounted in opening 48 and includes a spout door 52 having the same general dimensions as opening 48 so that spout door 52 can be received thereby as seen in the drawings. Spout door 52 is hinged at 54 to face plate 28 so that spout door 52 may be pivotally moved between open and closed positions by means of the door knob 56. A pair of vertically disposed and horizontally spaced-apart spout doors 58 and 60 are secured to the inside surface of spout door 52 and extend inwardly therefrom as seen in the drawings. The upper inner ends of spout doors 58 and 60 are provided with shoulders 62 and 64.

A generally rectangular box 66 is secured to the inside surface of face plate 28 and extends inwardly therefrom and has the same general outer dimensions as the opening 26 in package 12 so that the contents of the package will not tend to leak therefrom between the opening 26 and the exterior surfaces of the rectangular box 66. As a further aid in preventing leakage, a rubber seal 68 is positioned at the inside surface of face plate 28 around box 66 for engagement with the exterior surface of end wall 20 around opening 26.

The numeral 70 refers to a lower support which is secured to the lower end of rectangular box 66 and which extends downwardly and outwardly therefrom so that the lower end thereof will engage the inside surface of the package below opening 26 to maintain the pouring spout in position. The pouring spout 10 is further maintained in position by means of the pin means 46 which extends downwardly through upper support 42, through the top wall 14 of package 12, and through opening 45 in box 66.

The pouring spout of this invention is used as follows. When a package is purchased, an opening 26 is created in the upper end of end wall 20. The pouring spout 10 is received within the opening 26 as illustrated in the drawings and as will be described now. As seen in the drawings, the lower end of lower support 70 is inserted into the opening 26 and the pouring spout 10 is pivoted or rotated in a counterclockwise direction until the package at the lower end of the opening 26 is positioned between lower support 70 and the rubber seal 68 at the inside lower surface of the face plate 28. When the upper support 42 is positioned over the top wall 14 and the rubber seal 68 is in close engagement with the end wall 20 around the opening 26, pin 46 is inserted downwardly through opening 44 in upper support 42 and forced through top wall 14 and through opening 45 in box 66 to maintain the pouring spout in position. Thus, the cooperation of the pin means 46 extending through upper support 42 and top wall 14 together with the lower end of the lower support 70 engaging the inside surface of the package 12 positively maintains the pouring spout in position.

When it is desired to pour material from the package 12, lock 72 is pivotally moved to the unlocked position and the knob 56 grasped to pivotally move spout door 52 outwardly relative to the package. Spout door 52 may be pivotally moved to its open position until the shoulders 62 and 64 engage the rectangular box 66. With the spout door 52 in its open position, the contents in the package may be poured therefrom with the spout door 52 and the spout walls cooperating to form the pouring spout. The relationship of the components is such that material can only pass from the box through the pouring spout and will not be permitted to leak therefrom through the opening 26 around the pouring spout.

The pouring spout of this invention is easily transferred from one package to another and is extremely durable in use. Thus it can be seen that the pouring spout of this invention accomplishes at least all of its stated objectives.

I claim:

1. A pouring spout for application to a generally rectangular package having a top wall, side walls, end walls and a bottom wall, and a generally rectangular opening formed in one of said end walls adjacent the upper end thereof, comprising, a flat, generally rectangular face plate for positioning adjacent the outer surface of one of said end walls adjacent the upper end thereof, said face plate including an upper end, a lower end, inner and outer surfaces, and opposite side edges, said face plate having a spout opening formed therein having a spout means pivotally mounted therein and movable between open and closed positions, said spout means comprising a spout door which closes said spout opening when said spout means is in its closed position, said spout further comprising a pair of vertically disposed and horizontally spaced-apart spout walls extending inwardly from said spout door into the opening formed in the package, a horizontally disposed upper support extending from the upper end of said face plate over a portion of the top wall of the package, a removable pin means extending downwardly through said upper support into the top wall of the package to secure said spout means to the package, a lower support operatively secured to said face plate adjacent the lower end thereof which extends downwardly therefrom and which engages the inside surface of the end wall of the package to secure said spout means to the package, means for selectively maintaining said spout means in its closed position, and a seal means positioned between the inner surface of said face plate and the outside surface of the said end wall.

2. A pouring spout for application to a generally rectangular package having a top wall, side walls, end walls and a bottom wall, and a generally rectangular opening formed in one of said end walls adjacent the upper end thereof, comprising, a flat, generally rectangular face plate for positioning adjacent the outer surface of one of said end walls adjacent the upper end thereof, said face plate including an upper end, a lower end, inner and outer surfaces, and opposite side edges, said face plate having a spout opening formed therein having a spout means pivotally mounted therein and movable between open and closed positions, said spout means comprising a spout door which closes said spout opening when said spout means is in its closed position, said spout means further comprising a pair of vertically disposed and horizontally spaced-apart spout walls extending inwardly from said spout door into the opening formed in the package, a horizontally disposed upper support extending from the upper end of said face plate over a portion of the top wall of the package, a removable pin means extending downwardly through said upper support into the top wall of the package to secure said spout means to the package, a lower support operatively secured to said face plate adjacent the lower end thereof which extends downwardly therefrom and which engages the inside surface of the end wall of the package to secure said spout means to the package, means for selectively maintaining said spout means in its closed position, a generally rectangular box means extending inwardly from said face plate through the rectangular opening in the package, said box means having outside dimensions substantially equal to the dimensions of the opening in the package, said spout walls having means thereon for engagement with said rectangular box means for limiting the opening of said spout means.

3. A pouring spout for application to a generally rectangular package having a top wall, side walls, end walls and a bottom wall, and a generally rectangular opening formed in one of said end walls adjacent the upper end thereof, comprising, a flat, generally rectangular face plate for positioning adjacent the outer surface of one of said end walls adjacent the upper end thereof, said face plate including an upper end, a lower end, inner and outer surfaces, and opposite side edges, said face plate having a spout opening formed therein having a spout means pivotally mounted therein and movable between open and closed positions, said spout means comprising a spout door which closes said spout opening when said spout means is in its closed position, said spout means further comprising a pair of vertically disposed and horizontally spaced-apart spout walls extending inwardly from said spout door into the opening formed in the package, a horizontally disposed upper support extending from the upper end of said face plate over a portion of the top wall of the package, a removable pin means extending downwardly through said upper support into the top wall of the package to secure said spout means to the package, a lower support operatively secured to said face plate adjacent the lower end thereof which extends downwardly therefrom and which engages the inside surface of the end wall of the package to secure said spout means to the package, means for selectively maintaining said spout means in its closed position, a generally rectangular box means extending inwardly from said face plate through the rectangular opening in the package, said box means having outside dimensions substantially equal to the dimensions of the opening in the package, said lower support being secured to said rectangular box means and extending downwardly and outwardly therefrom.

4. A pouring spout for application to a generally rectangular package having a top wall, side walls, end walls and a bottom wall, and a generally rectangular opening formed in one of said end walls adjacent the upper end thereof, comprising, a flat, generally rectangular face plate for positioning adjacent the outer surface of one of said end walls adjacent the upper end thereof, said face plate including an upper end, a lower end, inner and outer surfaces, and opposite side edges, said face plate having a spout opening formed therein having a spout means pivotally mounted therein and movable between open and closed positions, said spout means comprising a spout door which closes said spout opening when said spout means is in its closed position, said spout means further comprising a pair of vertically disposed and horizontally spaced-apart spout walls extending inwardly from said spout door into the opening formed in the package, a horizontally disposed upper support extending from the upper end of said face plate over a portion of the top wall of the package, a removable pin means extending downwardly through said upper support into the top wall of the package to secure said spout means to the package, a lower support operatively secured to said face plate adjacent the lower end thereof which extends downwardly therefrom and which engages the inside surface of the end wall of the package to secure said spout means to the package, means for selectively maintaining said spout means in its closed position, a generally rectangular box means extending inwardly from said face plate through the rectangular opening in the package, said box means having outside dimensions substantially equal to the dimensions of the opening in the package, said pin means also extending through the upper end of said box means.

* * * * *